US011484473B2

(12) United States Patent
Mack et al.

(10) Patent No.: US 11,484,473 B2
(45) Date of Patent: Nov. 1, 2022

(54) CAPSULE SHREDDING DEVICE

(71) Applicant: THE HOSPITAL FOR SICK CHILDREN, Toronto (CA)

(72) Inventors: Lynn Mack, Toronto (CA); Thomas Looi, Markham (CA); Renu Roy, Toronto (CA); Melina Cheong, Mississauga (CA); Marcia Palmer, Whitby (CA); Michael Hartman, Burlington (CA)

(73) Assignee: THE HOSPITAL FOR SICK CHILDREN, Toronto (CA)

( * ) Notice: Subject to any disclaimer, the term of this patent is extended or adjusted under 35 U.S.C. 154(b) by 408 days.

(21) Appl. No.: 16/618,721

(22) PCT Filed: Jun. 1, 2018

(86) PCT No.: PCT/CA2018/050653
§ 371 (c)(1),
(2) Date: Dec. 2, 2019

(87) PCT Pub. No.: WO2018/218369
PCT Pub. Date: Dec. 6, 2018

(65) Prior Publication Data

US 2020/0163842 A1 May 28, 2020

Related U.S. Application Data

(60) Provisional application No. 62/514,259, filed on Jun. 2, 2017.

(51) Int. Cl.
*A61J 7/00* (2006.01)

(52) U.S. Cl.
CPC ..... *A61J 7/0007* (2013.01)

(58) Field of Classification Search
CPC ..... A61J 7/0007; A61J 7/0053
See application file for complete search history.

(56) References Cited

U.S. PATENT DOCUMENTS 2,602,596 A * 7/1952 Jones ..... A61J 7/0007 241/270
4,366,930 A * 1/1983 Trombetti, Jr. ..... A61J 7/0007 241/199.12

(Continued)

FOREIGN PATENT DOCUMENTS

CA 2797527 A1 11/2013
CN 101002719 A 7/2007

(Continued)

OTHER PUBLICATIONS

International Search Report dated Sep. 28, 2018 for PCT/CA2018/050653 filed Jun. 1, 2018.

*Primary Examiner* — Faye Francis
(74) *Attorney, Agent, or Firm* — Hill & Schumacher

(57) ABSTRACT

A capsule shredding device is provided, which includes first and second housing sections. The first housing section has a chamber slightly larger than the capsule located in one end of the housing section so that when the capsule is seated in the chamber it cannot freely rotate in the chamber. A vial is releasably coupled to other end of the first housing section. One or more passageways extend from the bottom of the chamber toward the other end of the second housing section. The second housing section has an internal chamber with a spike extending into the chamber integrally formed on the interior upper section of the housing section. When the two housing sections are threaded together such that are drawn towards each other, the spike pierces the capsule, and upon further rotation the spike shreds the capsule thereby releasing the powder contained therein which flows through the one or more passageways into interior of the vial. Gaskets (Continued)

between the first and second housing sections and between the second housing section and the vial prevent powder or liquid in the vial escaping.

23 Claims, 6 Drawing Sheets

(56) References Cited

U.S. PATENT DOCUMENTS

| | | | | |
|---|---|---|---|---|
| 4,765,549 | A * | 8/1988 | Sherman | A61J 7/0007 D24/220 |
| 4,967,971 | A * | 11/1990 | Smith | A61J 7/0007 241/DIG. 27 |
| 5,322,227 | A * | 6/1994 | Fiocchi | A61J 7/0007 241/100 |
| 10,709,641 | B2 * | 7/2020 | Yang | B02C 19/08 |
| 10,940,089 | B2 * | 3/2021 | Abusbeih | A61M 5/31511 |
| 11,166,878 | B2 * | 11/2021 | Macy, Jr. | A61J 3/02 |
| 2010/0258565 | A1 * | 10/2010 | Isaacson | B09B 3/0075 220/324 |
| 2012/0048978 | A1 | 3/2012 | Ling | |
| 2013/0299615 | A1 * | 11/2013 | Priebe | A61J 7/0007 241/26 |
| 2016/0354282 | A1 * | 12/2016 | Macy, Jr. | A61J 3/002 |
| 2018/0271751 | A1 * | 9/2018 | Torres | B02C 19/08 |
| 2018/0333332 | A1 * | 11/2018 | Abusbeih | A61J 7/0007 |
| 2019/0091104 | A1 * | 3/2019 | Yang | B02C 19/08 |
| 2019/0091105 | A1 * | 3/2019 | Jarvis | B02C 19/20 |

FOREIGN PATENT DOCUMENTS

| | | | |
|---|---|---|---|
| CN | 203227037 | U | 10/2013 |
| CN | 106860022 | A | 6/2017 |
| DE | 19706341 | A1 | 5/1998 |
| KR | 200467746 | Y1 | 7/2013 |
| TW | 200467746 | Y1 | 7/2013 |
| TW | M469913 | U | 1/2014 |
| TW | M552813 | U | 12/2017 |
| WO | 2011117512 | A1 | 9/2011 |
| WO | 2015113040 | A1 | 7/2015 |

* cited by examiner

CAPSULE SHREDDING DEVICE

FIELD

This disclosure relates to a capsule shredding device, and more specifically a device for shredding pharmaceutical capsules containing a powdered medicament.

BACKGROUND

In the present disclosure, the term "pill" refers to a vehicle for orally consuming a drug by swallowing said pill and the term "pill" encompasses specific vehicles for oral medication such as capsules and tablets. It is acknowledged that the technical definition of a "pill" defines an outdated dosage form, but the term is commonly used as a general term to describe a vehicle for orally administering a drug.

Some patients have difficulty swallowing pills. Many methods exist to transform medication from capsule form into a form that can be administered in a way that is received more easily by a patient than swallowing a capsule. Furthermore, capsules are manufactured in predetermined dosages and therefore one cannot change the dosage. It is well known in the art that the medication contained within a given capsule can be extracted so a desired dosage may be prepared.

One common method to make medication in a tablet easier to receive is to crush the tablet using a pill crushing device, but this only works well on tablets. Pill crushing devices apply force to the tablet to crush it into a fine powder that can be consumed in a liquid form. Alternatively, some pill crushers grind the tablet into a powder. However, pill crushers and grinders to not work well with hard-shelled capsules that contain medication within a two-piece shell.

A common method of removing medication from a hard-shelled capsule is to remove one of the capsule halves and then the medication, in the form of powder or pellets can be removed. The medication in the form of powder or pellets can then be made into a form that is easier for a patient with difficulty swallowing to receive. Additionally, the dosage can be adjusted. Some medications are toxic, so the person who opens the capsule is at risk of exposure. Therefore, it would be desirable to have a device where the medication can be extracted from a hard-shelled capsule while preventing the operator from being exposed to the medication.

SUMMARY

The present disclosure provides a capsule shredding device for shredding capsules containing powder medicament. The shredding device includes a first housing section having a first chamber formed in a first end of the first housing section for holding a capsule. The first housing section has an open second end, and includes at least one passageway through a bottom of the first chamber to a second chamber which extends to the open second end. A vial is removably coupled to the open second end of the first housing section. A second housing section has an open end and a closed end and has a second housing chamber formed therein. The closed end has a shredding spike formed thereon which extends from the closed end on an interior of the second housing section into the second housing chamber. The first and second housing sections have cooperating coupling mechanisms for coupling the open end of the second housing to the first end of the first housing section such that the shredding spike makes contact with a capsule in the first housing chamber. The cooperating coupling mechanisms are configured to allow telescoping rotational movement of the first housing section with respect to the second housing section so the shredding spike rotates with respect to the capsule thereby shredding it causing the powder medicament to flow through the at least one passageway into the vial.

The first and second housing sections may be cylindrically shaped, and the first end of the first housing may have external threading around an outer periphery of the first end, and the cylindrically shaped second housing may include internal threading on an interior wall of the second housing section enclosing the second chamber such that the first housing can be threaded into the open second end of the second housing section such that the first and second housing sections can be rotated with respect to each other thereby causing the shredding spike to penetrate into the capsule during rotation of the first housing section with respect to the second housing section.

The shredding spike may be a pyramidal shaped shredding spike having four triangular shaped flat surfaces, at least one of the four triangular shaped flat surfaces may include spike extending therefrom. Alternatively, each of the four triangular shaped flat surfaces includes a spike extending therefrom.

The first chamber may have a shape and size to receive the capsule therein such that the capsule is held in a fixed position with respect to the first housing section and cannot rotate freely within the first chamber.

The first chamber is preferrably sufficiently deep such that the capsule is entirely contained within the chamber such that it does not protrude out of the first chamber.

The capsule shredding device may include a gasket disposed between the first and second housing sections to provide a seal when the first and second housing sections are coupled together and the capsule is being shredded to prevent any escape of the powder medicament from the first chamber.

One or both of the first and second housing sections may include textured outer surfaces for improved gripping of the first and second housing sections during rotation of one with respect to the other. These grip features may be recesses or ridges.

The vial removably coupled to the open second end of the first housing section is preferably threaded, and an interior wall of the first housing has a complimentary thread such that the vial can be threaded into the open second end of the first housing section.

The capsule shredding device may include a gasket disposed between the first housing section and the vial to provide a liquid tight seal between the first housing section and the vial when the first housing section and the vial are coupled together and the capsule is being shredded to prevent any escape of the powder medicament or liquid from the vial.

The capsule shredding device is configured to be operated by hand.

The capsule shredding device may include an extraction cap attachment port attached to the second housing section to which an extraction cap can be attached, and including at least one extraction channel between the second housing section and the extraction cap attachment port.

The capsule shredding device may include capsule holding span members in said at least one passageway of said first housing section such that said capsule holding span members prevent a capsule from exiting said first chamber through said at least one passageway.

A further understanding of the functional and advantageous aspects of the invention can be realized by reference to the following detailed description and accompanying drawings.

BRIEF DESCRIPTION OF DRAWINGS

Embodiments will now be described, by way of example only, with reference to the drawings, in which.

DETAILED DESCRIPTION OF THE INVENTION

The device described herein is directed, in general, to capsule shredding devices and more specifically to hard-shelled capsule shredding devices. Although an embodiment of the present disclosure is described herein, the disclosed embodiment is merely exemplary and it should be understood that the disclosure relates to many alternative forms, including different shapes and sizes. The specific structural and functional details disclosed herein are not to be interpreted as limiting but merely as a basis for the claims and as a representative basis for enabling someone skilled in the art to employ the present invention in a variety of manners.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

As used herein, the terms "about" and "approximately", when used in conjunction with ranges of dimensions, compositions of mixtures or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

As used herein, the coordinating conjunction "and/or" is meant to be a selection between a logical disjunction and a logical conjunction of the adjacent words, phrases, or clauses. Specifically, the phrase "X and/or Y" is meant to be interpreted as "one or both of X and Y" wherein X and Y are any word, phrase, or clause.

Figure 1:
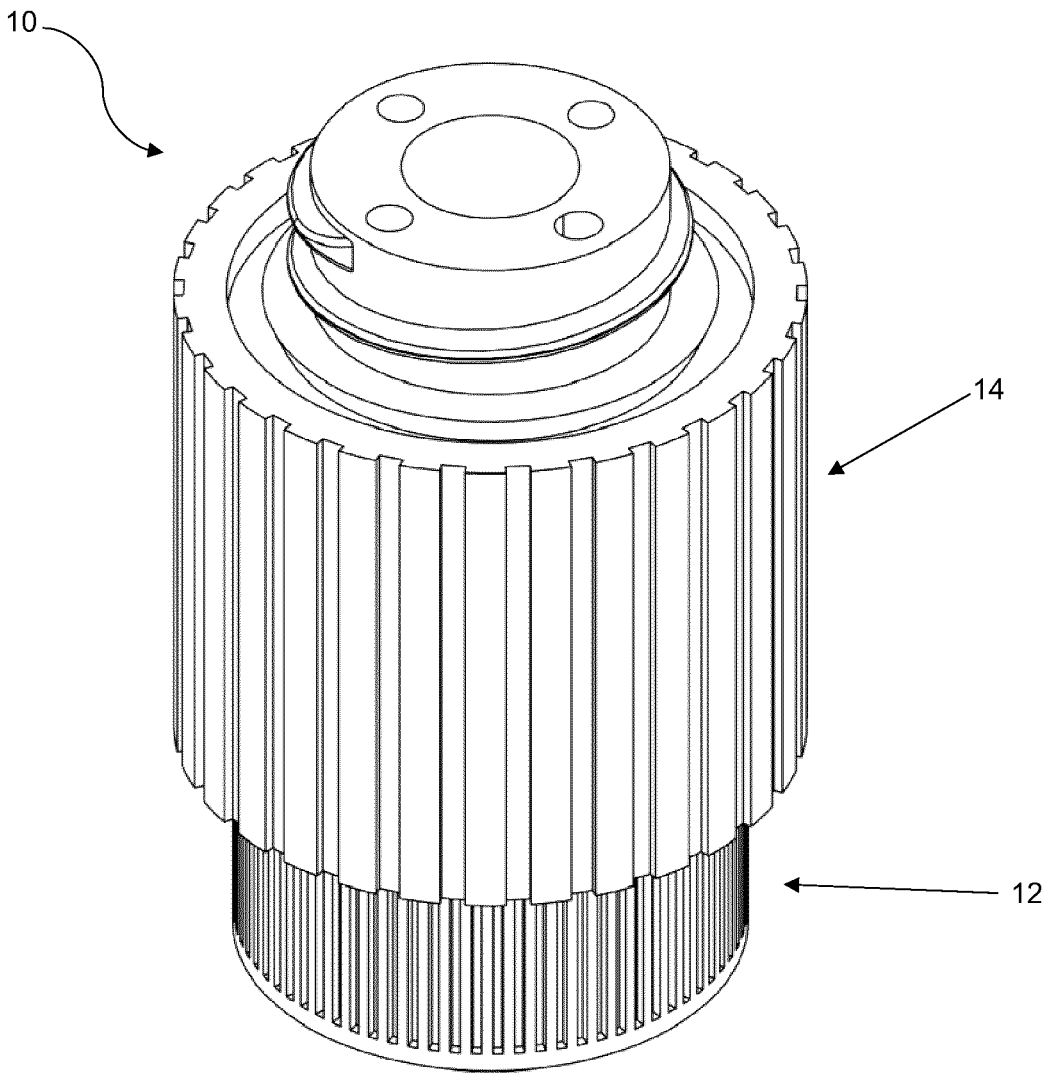
FIG. 1 is a perspective view of the capsule shredder assembly assembled together.
Figure 2:
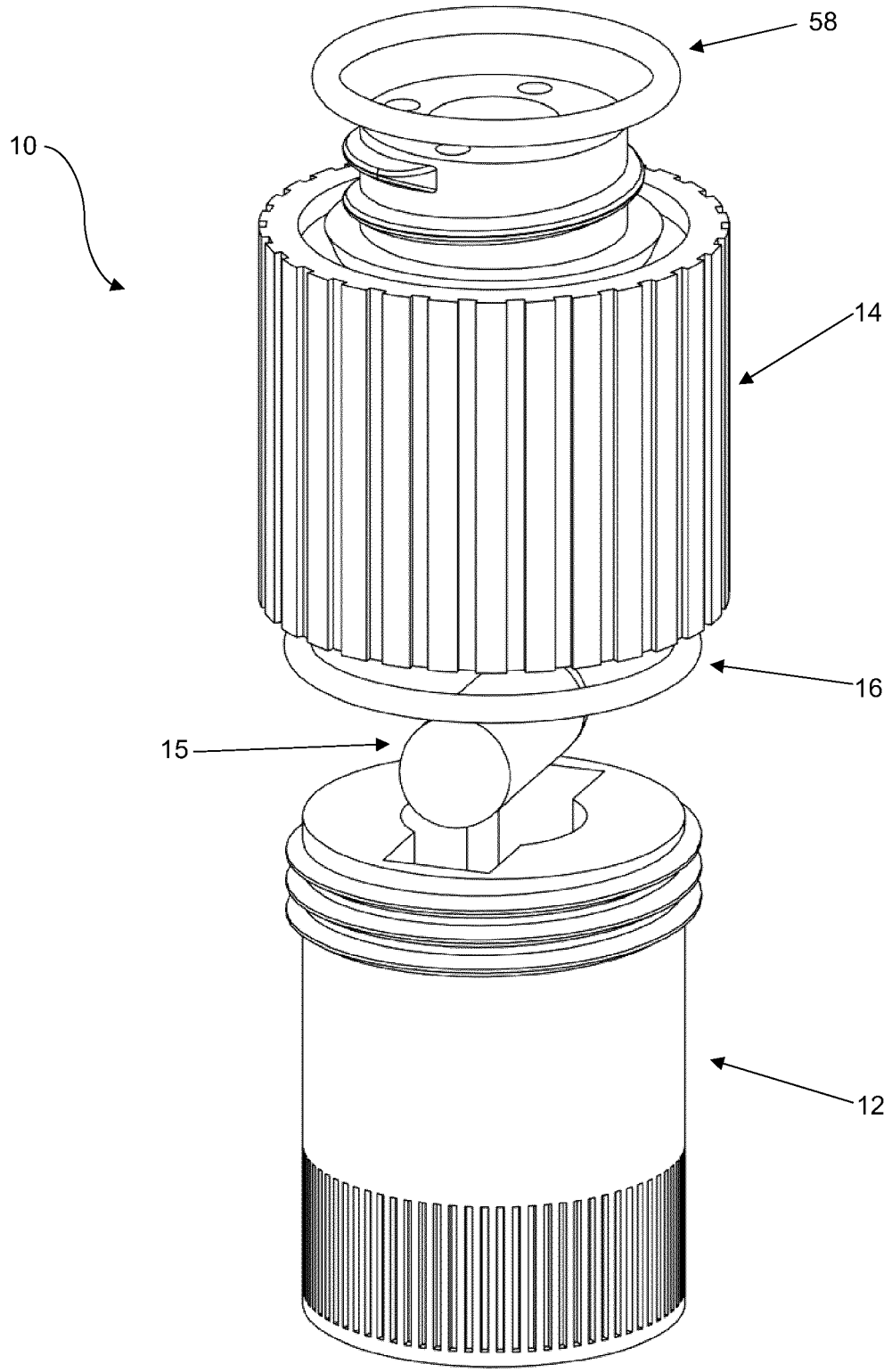
FIG. 2 is an exploded view of the capsule shredder assembly in disassembled view showing top and bottom pieces of the assembly separated with a typical capsule shown between them.

The capsule shredding device of the present disclosure, an embodiment of which is shown at 10 in FIG. 1 and FIG. 2 comprises a male component 12 which is screwed into a female component 14 with a first O-ring 16 between the two components. A typical hard shelled capsule 15 is shown located between the two sections 12 and 14. The purpose of the O-ring 16 is to provide a seal between sections 12 and 14 to prevent escape of any of the powder medicament being released by the shredding of capsule 15.

Figure 4:
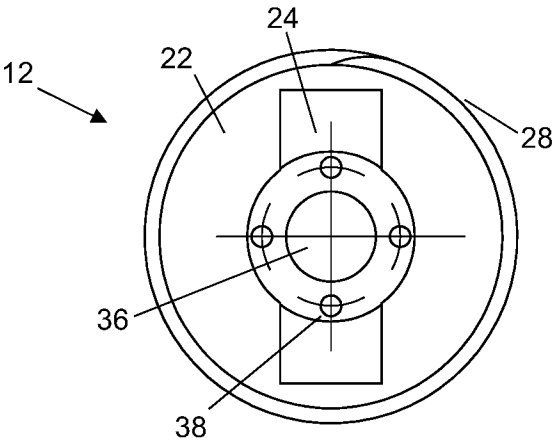
FIG. 4 is a top view of the bottom piece of FIG. 3.
Figure 5:
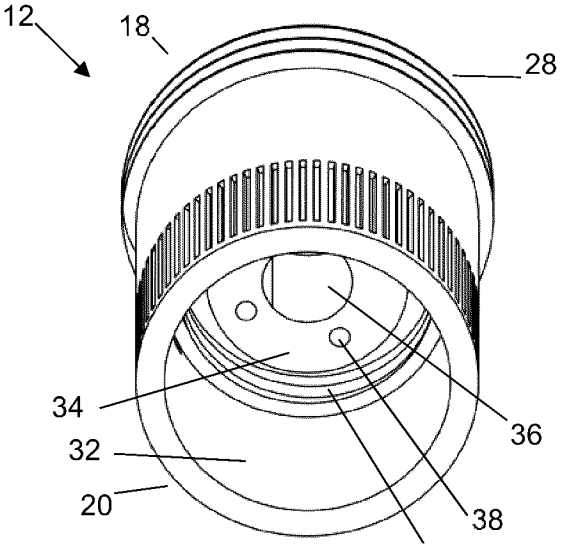
FIG. 5 is a bottom perspective view of the bottom piece of FIG. 3.
Figure 3:
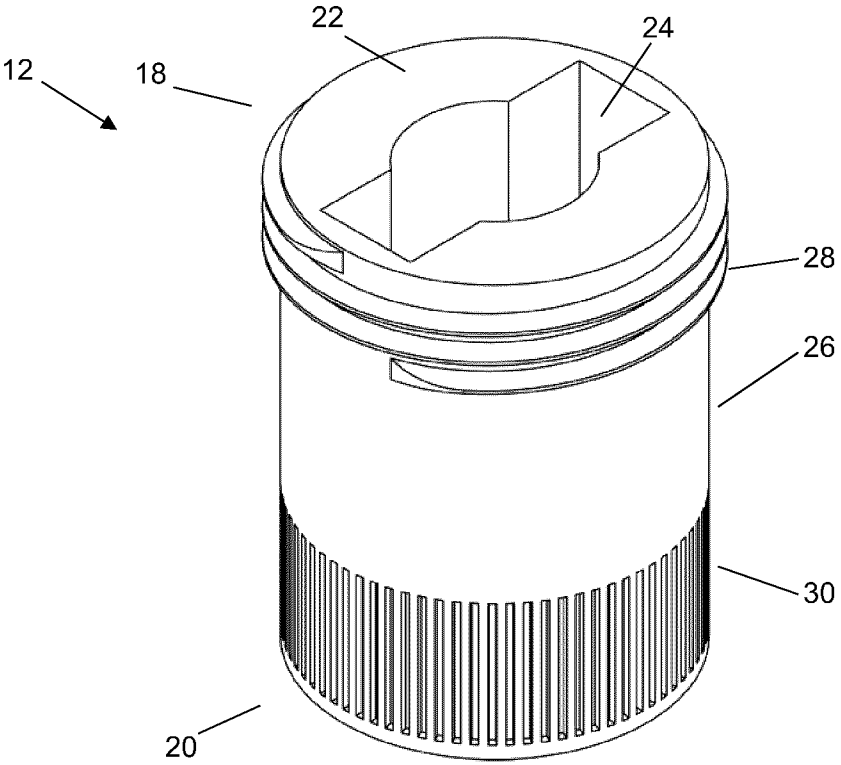
FIG. 3 is a top perspective view of an embodiment of the bottom piece.

The cylindrical male housing section 12 is shown in more detail in FIG. 3, FIG. 4 and FIG. 5 where the male component 12 is shown as being cylindrical in shape, having a top portion 18 for receiving the female component 14 and a bottom portion 20 for receiving a plastic threaded vial or test tube (not shown). The top portion 18 having an insertion face 22 with a capsule cavity 24 in the insertion face 22 into which the capsule 15 is received. The capsule cavity 24 is shaped to hold the hard-shelled capsule 15 in such a way that a hard-shelled capsule 15 can be inserted within the cavity. In an embodiment, the capsule cavity 24 is shaped such that the capsule 15 does not protrude from the insertion face 22.

The capsule cavity 24 may be shaped in such a way that when the hard-shelled capsule 15 is placed within the capsule cavity 24 it will have restricted rotational freedom relative to the cylindrical male housing section 12. The outer surface of the male housing section 12 has external threading 28 at the top portion 18. The outer surface of the male housing section 12 also has a series of grip recesses 30 extending circumferentially around the bottom portion 20 of lower housing section 12 to provide a suitable grip to for a user threading the sections 12 and 14 together once capsule 15 has been placed into receptacle 24. The inner surface of the bottom portion 20 of the male component 12 defines a receiving space 32 for a vial/test tube and vial/test tube attachment port 34 proximate to the top portion of the male housing section 12. The vial/test tube attachment port 34 has features allowing a vial to be removably attached to the male component. Specifically, a threaded section 21 on the upper interior portion of male housing section 12 is threaded onto a complimentary threaded section on the upper outer portion of the vial or test tube 70 (FIG. 9) to discussed below. However, it will be understood that the vial may not need to be threaded to the housing section 12, and an unthreaded connection may be made as long as there is a good friction fit to ensure the vial and housing section 12 do not become decoupled during the shredding operation. A channel 36 is formed between the capsule cavity 24 and the vial port 34 such that the contents released from the shredded capsule 15 pass through the channel 36 and collected in the vial. In an embodiment of the present disclosure, one or more supplementary collection channels 38 can be formed concentric with the centrally located collection channel 36.

Figure 7:
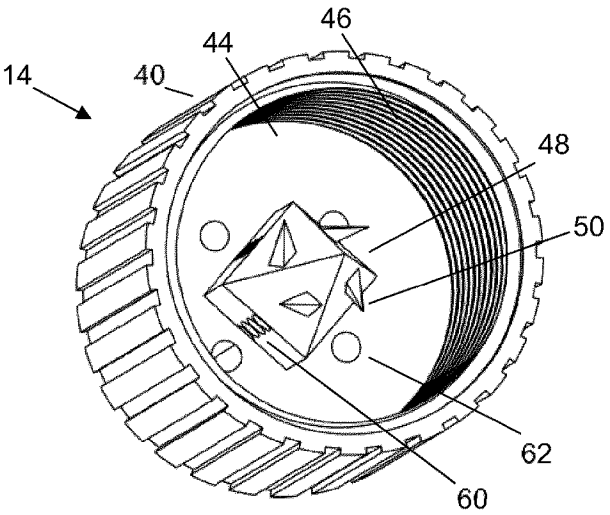
FIG. 7 is a bottom perspective view of the top piece of FIG. 6 at a steep angle to show the internal spike.
Figure 8:
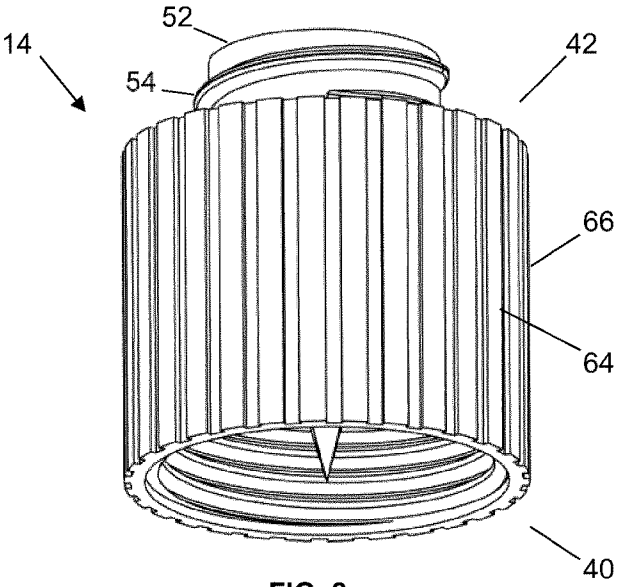
FIG. 8 is a bottom perspective view of the top piece of FIG. 6.
Figure 6:
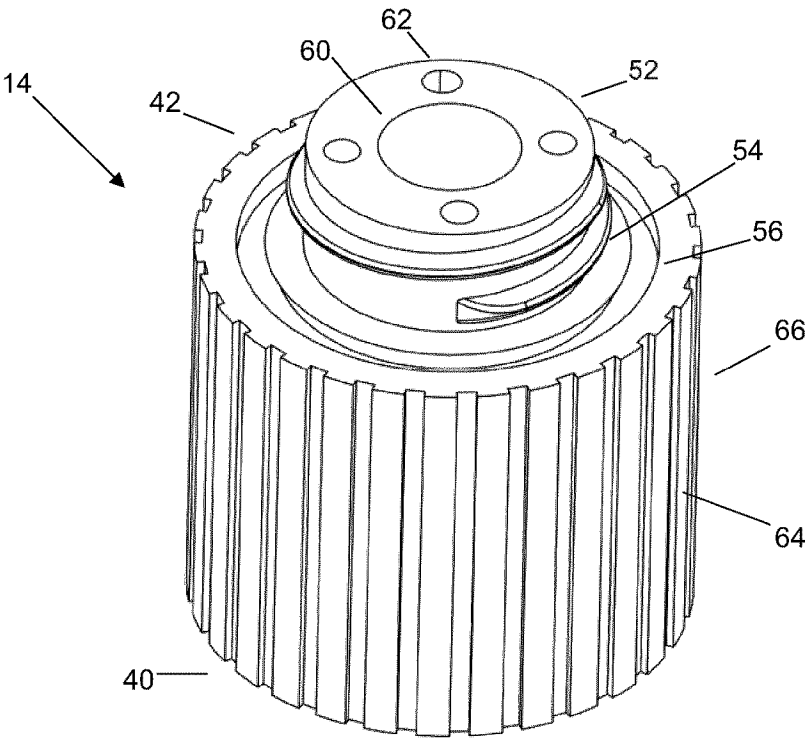
FIG. 6 is a top perspective view of an embodiment of the top piece.

The female housing section 14 is shown in more detail in FIG. 6, FIG. 7 and FIG. 8 wherein the cylindrically shaped female housing section 14 has a bottom portion 40 for receiving the male component 12 into a reception chamber 44, and a top portion 42 for attaching an extraction cap. The wall of the reception chamber 44 has internal threading 46 that is compatible with the external threading 28 of the male housing section 12 so that the insertion face 22 of the male housing section 12 can be inserted into the reception cavity 44 of the female housing section 14 and then the female housing section 14 can be rotated relative to the male housing section 12 such that the insertion face 22 linearly translates further into the reception cavity 44. The female housing section 14 is rotated clockwise relative to the male housing section 12 when the female housing section 14 is viewed as the top component.

The present shredding device 10 includes a pyramidal-shaped spike 48 projecting from the bottom of the reception chamber 44 and which each face of the spike having a small spike 50 projecting from the face or sides of spike 48. In the embodiment shown the spike is a square based pyramidal-shaped spike with each face having a small spike 50 but it will be appreciated that four spikes 50 are not required and there may be only one, two or three, however having four will give the most efficient performance in respect of shredding the capsule. Furthermore, the square spike 48 has a base section that is perpendicular to the base of the reception cavity 44, between the base of the reception cavity 44 and the pyramid section where the spike focuses at a sharp point. There is an extraction cap attachment port 52 proximate to the top portion 42 around which there is extraction cap attachment threading 54 so an extraction cap can be removably attached to the extraction cap attachment port 52. Furthermore, there is a trench 56 around the base of the extraction cap attachment port 52 so that a gasket 58 (FIG. 2) is placed within the circumferential trench 56 in housing section 14 thus ensuring a sealed fit between the extraction cap and the female housing section 14. In an embodiment, the gasket 58 is an O-ring. A channel 60 is formed between the base of the reception cavity 44 and the extraction cap attachment port 52, the extraction channel 60 has multiple small openings in the base of the square spike 48. Additionally, there are one or more supplementary extraction channels 62 between the reception cavity 44 and the extraction cap attachment port 52. In a preferred embodiment, the supplementary extraction channels 62 are concentric with the square spike 48. There is a series of grip ridges 64 around the outer surface 66 of the female component 14. An oral syringe can be removably attached to the extraction cap such that at least one continuous cavity is formed between the oral syringe and the reception cavity 44 via the extraction channel 60 and the extraction cap and/or the supplementary extraction channels 62 and the extraction cap.

A gasket 16 as seen in FIG. 2 can be inserted between the male housing section 12 and the female housing section 14 to provide a sealed fit between the male housing section 12 and the female housing section 14 when the male housing section 12 is fully screwed into the female housing section 14. The gasket 16 may be an O-ring, but other types of gaskets may be used.

In use medication can be safely extracted from a hard-shelled capsule 15 in using the following procedure. An extraction cap is attached to the extraction cap attachment port 52 of the female housing section 14 with a gasket between the extraction cap, an oral syringe is attached to the extraction cap and the female component and a vial containing solvent is coupled to the vial attachment port 34 of the male housing section 12. A hard-shelled capsule 15 is positioned within the capsule cavity 24 and the gasket 16 is inserted in the bottom of the reception chamber 44 after the insertion face 22 of the male housing section 12 is inserted into the mouth of the reception cavity 44 such that the external threading 28 engages the compatible internal threading 46. A torque is then applied to one of the male 12 or female housing section 14 causing the female housing section 14 to rotate relative to the male housing section 12 in the direction which causes the external threading 28 to further engage the internal threading 46 causing the male housing section 12 to translate further into the female housing section 14.

Figure 9:
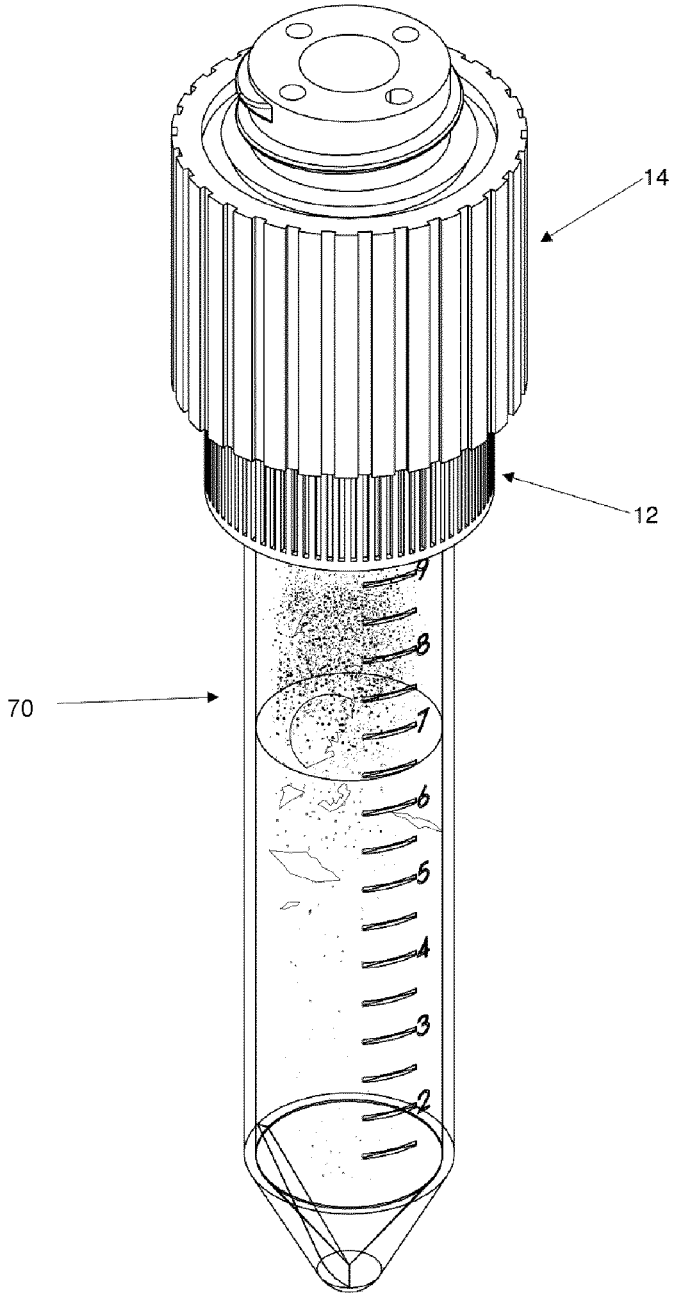
FIG. 9 shows the capsule shredding device assembled with a vial into which the powder from the shredded capsule falls.

FIG. 9 shows the capsule shredding device 10 assembled with a vial 70 into which the powder from the shredded capsule 15 falls. The capsule shredding device 10 may be held upright with the female housing section 14 at the top so gravity assists in the collection of the medication in vial 70. As the male component 12 moves further into the reception cavity 44, the capsule 15 in the capsule cavity 24 is pierced by the square spike 48 and then the capsule 15 is shredded as the square spike 48 rotating relative to the male component 12 moves further through the capsule and the smaller spikes 50 contact capsule 15, thereby piercing it and as the female component 14 is rotated relative to the male component 12 the capsule 15 is shredded. The shredded capsule 15 and medication falls through the collection channels 36 and 38 from the base of the capsule cavity 24 into the vial wherein the mediation is dissolved in the solvent; the capsule shredding device 10 is then inverted so that the medication solution moves through the collection channels 36 and 38 from the vial attachment port 34 into the capsule cavity 24 where any remaining medication will be dissolved in the solution, the solution moves into the reception cavity 44 and moves into the extraction cap via the extraction channels 60 and 62; the medication solution can then be extracted from the extraction cap with the oral syringe and administered; and the capsule shredding device 10 can then be disassembled and each component can be separately cleaned.

The shredder 10 as shown in the FIG. 1 through FIG. 9 has beneficial design features including, but not restricted to: the capsule shredding device 10 is appropriately sized such that it can be operated by hand and does not require any additional power source; the recesses 30 and the ridges 64 allow an operator to easily grip the capsule shredding device 10; the capsule shredding device 10, when inverted channels the medication solution through the female component 14, meaning that for a leak to occur the medication solution must bypass the O-ring 16 and move up the wall of the reception cavity 44 between the female component 14 and the male component 12.

Figure 10:
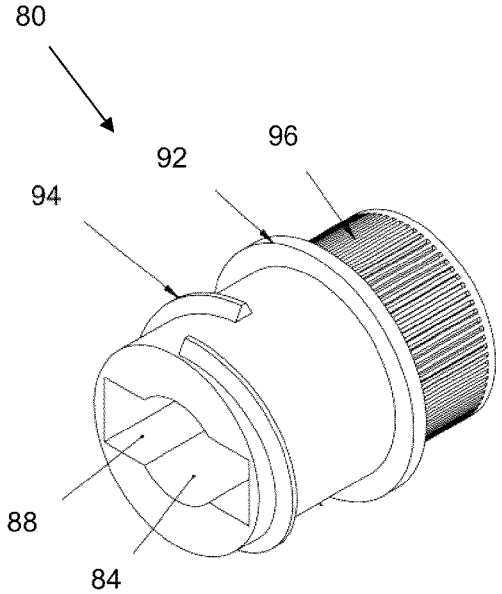
FIG. 10 is a side perspective view of an alternate embodiment of the bottom piece.
Figure 11:
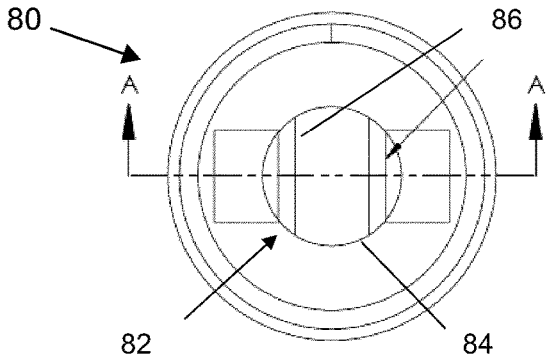
FIG. 11 is a top view of the bottom piece of FIG. 10.
Figure 12:
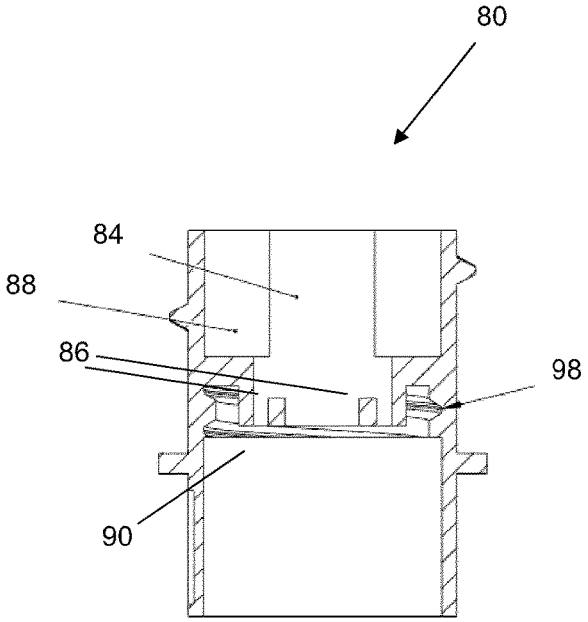
FIG. 12 is a section view of the bottom piece of FIG. 10 cut along the cutting plane shown in FIG. 11.

An alternate embodiment of the male housing 80 is shown in detail in FIG. 10, FIG. 11 and FIG. 12. The alternate male housing 80 has a similar shape and the same function to male housing 12, but the alternate male housing 80 has a slotted hole 82 comprising a large channel 84 and at least one capsule holding span members 86 (two of them shown). The large channel 84 connects the capsule cavity 88 and the vial attachment port 90 and provides the same general function as the channel 36 of the male housing 12. However, the large channel 84 is larger in diameter than channel 36 which provides improved performance in collecting the medication in a vial attached to the vial attachment port 90 and in extracting the medication solution from the embodiment of the capsule shredding device containing alternate male housing 80. The capsule holding span members 86 are shown in detail in FIG. 11 and span a portion of the large channel 84 to hold the capsule in the capsule cavity 88 such that the capsule can be shredded without the capsule falling through the large channel 84. The slotted hole 82 of the alternate male housing 80 decreases the amount of solvent or medication solution that becomes stuck in the capsule shredding device due to surface tension. Additionally, the alternate male housing 80 has a lip 92. The alternate male housing 80 has external threading 94, grip recesses 96 and vial attachment threading 98 which perform the same function as their respective features on the male housing 12. The threading 94 is a single wrap around thread, different from threading 28 which has multiple wraps around the body. Threading 94 is advantageous over threading 28 in that it allows easier mating of the two housing sections and reduces the chances of miss-threading occurring.

It will be understood that the shredding device disclosed herein may be constructed for different sized capsules.

Thus, in summary the present disclosure provides a capsule shredding device for shredding capsules containing powder medicament. In an embodiment the shredding device includes a first housing section having a first chamber formed in a first end of the first housing section for holding a capsule. The first housing section has an open second end, and includes at least one passageway through a bottom of the first chamber to a second chamber which extends to the open second end. A vial is removably coupled to the open second end of the first housing section. A second housing section has an open end and a closed end and has a second housing chamber formed therein. The closed end has a shredding spike formed thereon which extends from the closed end on an interior of the second housing section into the second housing chamber. The first and second housing sections have cooperating coupling mechanisms for coupling the open end of the second housing to the first end of the first housing section such that the shredding spike makes contact with a capsule in the first housing chamber. The cooperating coupling mechanisms are configured to allow telescoping rotational movement of the first housing section with respect to the second housing section so the shredding spike rotates with respect to the capsule thereby shredding it causing the powder medicament to flow through the at least one passageway into the vial.

In an embodiment the first and second housing sections are cylindrically shaped, and the first end of the first housing may have external threading around an outer periphery of the first end, and the cylindrically shaped second housing may include internal threading on an interior wall of the second housing section enclosing the second chamber such that the first housing can be threaded into the open second end of the second housing section such that the first and second housing sections can be rotated with respect to each other thereby causing the shredding spike to penetrate into the capsule during rotation of the first housing section with respect to the second housing section.

In an embodiment the shredding spike is a pyramidal shaped shredding spike having four triangular shaped flat surfaces, at least one of the four triangular shaped flat surfaces may include spike extending therefrom. Alternatively, each of the four triangular shaped flat surfaces includes a spike extending therefrom.

In an embodiment the first chamber has a shape and size to receive the capsule therein such that the capsule is held in a fixed position with respect to the first housing section and cannot rotate freely within the first chamber.

In an embodiment the first chamber is sufficiently deep such that the capsule is entirely contained within the chamber such that it does not protrude out of the first chamber.

In an embodiment the capsule shredding device includes a gasket disposed between the first and second housing sections to provide a seal when the first and second housing sections are coupled together and the capsule is being shredded to prevent any escape of the powder medicament from the first chamber.

In an embodiment the one or both of the first and second housing sections include textured outer surfaces for improved gripping of the first and second housing sections during rotation of one with respect to the other. These grip features may be recesses or ridges.

In an embodiment the vial removably coupled to the open second end of the first housing section is preferably threaded, and an interior wall of the first housing has a complimentary thread such that the vial can be threaded into the open second end of the first housing section.

In an embodiment the capsule shredding device includes a gasket disposed between the first housing section and the vial to provide a liquid tight seal between the first housing section and the vial when the first housing section and the vial are coupled together and the capsule is being shredded to prevent any escape of the powder medicament or liquid from the vial.

In an embodiment the capsule shredding device is configured to be operated by hand.

In an embodiment the capsule shredding device includes an extraction cap attachment port attached to the second housing section to which an extraction cap can be attached, and including at least one extraction channel between the second housing section and the extraction cap attachment port.

In an embodiment the capsule shredding device may include capsule holding span members in said at least one passageway of said first housing section such that said capsule holding span members prevent a capsule from exiting said first chamber through said at least one passageway.

The foregoing description of the preferred embodiments of the disclosure has been presented to illustrate the principles of the disclosure and not to limit the disclosure to the particular embodiment illustrated. It is intended that the scope of the disclosure be defined by all of the embodiments encompassed within the following claims and their equivalents.

Therefore what is claimed is:

1. A capsule shredding device for shredding capsules containing powder medicament, comprising:

a first housing section having a first chamber formed in a first end of said first housing section for holding a capsule, said first housing section having an open second end, including at least one passageway through a bottom of said first chamber to a second chamber which extends to said open second end, a vial removably coupled to the open second end of said first housing section;

a second housing section having an open end and a closed end and having a second housing chamber formed therein, the closed end having a shredding spike formed thereon and extending from said closed end on an interior of the second housing section into said second housing chamber, said shredding spike having a pyramidal shape having four triangular shaped flat surfaces, at least one of said four triangular shaped flat surfaces including spike extending therefrom; and said first and second housing sections having cooperating coupling mechanisms for coupling the open end of the second housing to the first end of said first housing section such that the shredding spike makes contact with a capsule in said first housing chamber, said cooperating coupling mechanisms configured to allow telescoping rotational movement of the first housing section with respect to said second housing section so said shredding spike rotates with respect to the capsule thereby shredding it causing the powder medicament to flow through said at least one passageway into said vial.

2. The capsule shredding device according to claim 1, wherein said first and second housing sections are cylindrically shaped, and wherein said first end of said first housing has external threading around an outer periphery of said first end, and wherein the cylindrically shaped second housing includes internal threading on an interior wall of said second housing section enclosing said second chamber such that the first housing can be threaded into the open second end of the second housing section such that said first and second housing sections can be rotated with respect to each other thereby causing the shredding spike to penetrate into the capsule during rotation of the first housing section with respect to the second housing section.

3. The capsule shredding device according to claim 2, wherein said shredding spike is a pyramidal shaped shredding spike having four triangular shaped flat surfaces, at least one of said four triangular shaped flat surfaces including spike extending therefrom.

4. The capsule shredding device according to claim 3, wherein each of said four triangular shaped flat surfaces includes a spike extending therefrom.

5. The capsule shredding device according to claim 2, wherein said first chamber has a shape and size to receive the capsule therein such that the capsule is held in a fixed position with respect to the first housing section and cannot rotate freely within said first chamber.

6. The capsule shredding device according to claim 2 wherein said capsule holding section has a capsule holding cavity sized for a capsule to be placed in said capsule holding cavity.

7. The capsule shredding device according to claim 1, wherein each of said four triangular shaped flat surfaces includes a spike extending therefrom.

8. The capsule shredding device of claim 1, wherein said first chamber has a shape and size to receive the capsule therein such that the capsule is held in a fixed position with respect to the first housing section and cannot rotate freely within said first chamber.

9. The capsule shredding device of claim 1 wherein said capsule holding section has a capsule holding cavity sized for a capsule to be placed in said capsule holding cavity.

10. The capsule shredding device of claim 9 wherein said first chamber is sufficiently deep such that the capsule is entirely contained within the first chamber such that it does not protrude out of the first chamber.

11. The capsule shredding device of claim 1 including a gasket disposed between said first and second housing sections to provide a seal when the first and second housing sections are coupled together and the capsule is being shredded to prevent any escape of the powder medicament from the first chamber.

12. The capsule shredding device of claim 1 wherein said first and second housing sections include textured outer surfaces for improved gripping of said first and second housing sections during rotation of one with respect to the other.

13. The capsule shredding device of claim 1 wherein one or both of said first and second housing sections include exterior grip features.

14. The capsule shredding device of claim 13 wherein said grip features are recesses or ridges.

15. The capsule shredding device of claim 1 wherein said vial removably coupled to the open second end of said first housing section is threaded, and an interior wall of said first housing has a complimentary thread such that said vial can be threaded into said open second end of said first housing section.

16. The capsule shredding device of claim 1 including a gasket disposed between said first housing section and said vial to provide a liquid tight seal between said first housing section and said vial when the first housing section and said vial are coupled together and the capsule is being shredded to prevent any escape of the powder medicament or liquid from said vial.

17. The capsule shredding device of claim 1 wherein said capsule shredding device is configured to be operated by hand.

18. The capsule shredding device of claim 1 including an extraction cap attachment port attached to said second housing section to which an extraction cap can be attached, and including at least one extraction channel between said second housing section and said extraction cap attachment port.

19. The capsule shredding device of claim 1 including capsule holding span members in said at least one passageway of said first housing section such that said capsule holding span members prevent a capsule from exiting said first chamber through said at least one passageway.

20. A capsule shredding device for shredding capsules containing powder medicament, comprising:

a first housing section having a first chamber formed in a first end of said first housing section for holding a capsule, said first housing section having an open second end, including at least one passageway through a bottom of said first chamber to a second chamber which extends to said open second end, a vial removably coupled to the open second end of said first housing section, said first chamber having a shape and size to receive the capsule therein such that the capsule is held in a fixed position with respect to the first housing section and cannot rotate freely within said first chamber;

a second housing section having an open end and a closed end and having a second housing chamber formed therein, the closed end having a shredding spike formed thereon and extending from said closed end on an interior of the second housing section into said second housing chamber; and said first and second housing sections having cooperating coupling mechanisms for coupling the open end of the second housing to the first end of said first housing section such that the shredding spike makes contact with a capsule in said first housing chamber, said cooperating coupling mechanisms configured to allow telescoping rotational movement of the first housing section with respect to said second housing section so said shredding spike rotates with respect to the capsule thereby shredding it causing the powder medicament to flow through said at least one passageway into said vial.

21. The capsule shredding device according to claim 20, wherein said shredding spike is a pyramidal shaped shredding spike having four triangular shaped flat surfaces, at least one of said four triangular shaped flat surfaces including spike extending therefrom.

22. A capsule shredding device for shredding capsules containing powder medicament, comprising:

a first housing section having a first chamber formed in a first end of said first housing section for holding a capsule, said first housing section having an open second end, including at least one passageway through a bottom of said first chamber to a second chamber which extends to said open second end, a vial removably coupled to the open second end of said first housing section, including capsule holding span members in said at least one passageway of said first housing section such that said capsule holding span members prevent a capsule from exiting said first chamber through said at least one passageway;

a second housing section having an open end and a closed end and having a second housing chamber formed therein, the closed end having a shredding spike formed thereon and extending from said closed end on an interior of the second housing section into said second housing chamber; and said first and second housing sections having cooperating coupling mechanisms for coupling the open end of the second housing to the first end of said first housing section such that the shredding spike makes contact with a capsule in said first housing chamber, said cooperating coupling mechanisms configured to allow telescoping rotational movement of the first housing section with respect to said second housing section so said shredding spike rotates with respect to the capsule thereby shredding it causing the powder medicament to flow through said at least one passageway into said vial.

23. The capsule shredding device according to claim 22, wherein said shredding spike is a pyramidal shaped shredding spike having four triangular shaped flat surfaces, at least one of said four triangular shaped flat surfaces including spike extending therefrom.

* * * * *